US006311700B1

(12) United States Patent
Yeh

(10) Patent No.: US 6,311,700 B1
(45) Date of Patent: Nov. 6, 2001

(54) STAGE-BY-STAGE TIGHTNESS-ADJUSTABLE HAIR CLIP STRUCTURE

(76) Inventor: Stephen Yeh, 8F, No. 383, Chung-Ho Road, Yung-Ho City, Taipei Hsien (TW)

( * ) Notice: Subject to any disclaimer, the term of this patent is extended or adjusted under 35 U.S.C. 154(b) by 0 days.

(21) Appl. No.: 08/752,679

(22) Filed: Nov. 19, 1996

(51) Int. Cl.[7] ..... A45D 8/32
(52) U.S. Cl. ..... 132/279; 132/277
(58) Field of Search ..... 132/277, 278, 132/279, 276

(56) References Cited

U.S. PATENT DOCUMENTS 3,565,084 * 2/1971 Vuillard ..... 132/279
5,445,170 * 8/1995 Yasuda ..... 132/279

FOREIGN PATENT DOCUMENTS

539380 * 6/1922 (FR) ..... 132/279

* cited by examiner

*Primary Examiner*—Todd E. Manahan
(74) *Attorney, Agent, or Firm*—A & J

(57) ABSTRACT

A stage-by-stage tightness-adjustable hair clip structure includes a base plate, a leaf spring and a clip plate. Each end of the base plate is disposed with a pair of latch boards. Each end of the leaf spring is disposed with a pair of fork legs. Each end of the clip plate is disposed with a pair of latch lugs. One end of the hair clip can be a pivot end, while the other end thereof can be an openable end, whereby the hair clip is openable only at one end. Alternatively, both ends of the hair clip are openable ends, whereby the hair clip is openable at both ends. The tightness between the clip plate and the base plate is adjustable stage by stage according to the amount of a user's hair.

11 Claims, 11 Drawing Sheets

3a
38
33
10
3
2a
21
25
1a
12
11
24
2
1
H 394
161
161
11
11
393
393
21
16
1
16

3a
394
393
10
2a
3
21
22
1a
11
161
16
11
16
2
394
3a
393
22
21
2a
1
16
11
161
1a
16
11
161
11
394
21
11
16
10
2
1
3

161
394
3
16
393
11
2
21
1

K
161
394
11
J
K
21
J
11
21
393

STAGE-BY-STAGE TIGHTNESS-ADJUSTABLE HAIR CLIP STRUCTURE

BACKGROUND OF THE INVENTION

The present invention relates to a stage-by-stage tightness-adjustable hair clip structure which can be opened at one single end or at both ends. The tightness of the hair clip can be adjusted stage by stage according to the amount of a user's hair.

Most of the conventional hair clips are composed of a base plate, a leaf spring and a clip plate. Such hair clips are openable at one end rather than at both ends.

The earliest hair clip pertains to a one-stage hair clip which cannot be adjusted in tightness so that a user with less hair or more hair can hardly suitably use such hair clip. A multi-stage hair clip has been developed to solve this problem. However, such hair clip can be only opened at one end rather than at both ends.

Moreover, it is known that the consumers include right-handed users and left-handed users which use the hair clip by different way. The existing hair clips are all designed for the right-handed users, while the requirement of the left-handed users is always neglected. In addition, due to the limitation of the opening direction of the hair clip, the conventional hair clips are equipped with decorative articles in one single direction. Therefore, it is necessary to provide a hair clip which can be opened at both ends so that the requirements of both the right-handed users and left-handed users can be satisfied.

SUMMARY OF THE INVENTION

It is therefore a primary object of the present invention to provide a stage-by-stage tightness-adjustable hair clip structure including a base plate, a leaf spring and a clip plate. Each end of the base plate is disposed with a pair of latch boards. Each end of the leaf spring is disposed with a pair of fork legs. Each end of the clip plate is disposed with a pair of latch lugs. Accordingly, the hair clip are openable at both ends. The present invention includes five different aspects as follows:

1. The latch board of the base plate is disposed with a row of intercommunicated latch holes and the latch lug of the clip plate is disposed with a tenon for selectively inserting into the latch holes and assembling the clip plate with the base plate, whereby the tightness of the hair clip can be adjusted as necessary.

2. A latch hook extends from the latch board of the base plate and the latch lug of the clip plate is disposed with an engaging socket, whereby the latch hook can be hooked in the engaging socket to assemble the clip plate with the base plate and the tightness between the clip plate and the base plate is adjustable.

3. A latch arm extends from the latch board of the base plate for engaging with the engaging socket of the latch lug of the clip plate so that the clip plate is assembled with the base plate and the tightness between the clip plate and the base plate is adjustable.

4. The base plate is disposed with a rack and the leaf spring is also disposed with a cooperative rack, whereby a tenon of the clip plate can be selectively engaged with the racks to assemble the clip plate with the base plate and the tightness between the clip plate and the base plate is adjustable.

5. A rack extends from the fork leg of the leaf spring for engaging with the engaging socket of the clip plate, whereby the clip plate is assembled with the base plate and the tightness between the clip plate and the base plate is adjustable.

The openable end of each of the above aspects can be replaced by a conventional pivot end to form a hair clip which is openable only at one end.

The present invention has the following advantages:

1. The hair clip of the present invention can be opened at both ends in two directions so that both right-handed users and left-handed users can use the hair clip.

2. The tightness of the hair clip can be adjusted stage by stage according to the amount of the user's hair.

3. The decorative articles can be disposed on the hair clip in at least two directions.

The present invention can be best understood through the following description and accompanying drawing, wherein:

DETAILED DESCRIPTION OF THE PREFERRED EMBODIMENTS

Figures 1A, 1B, 1C:
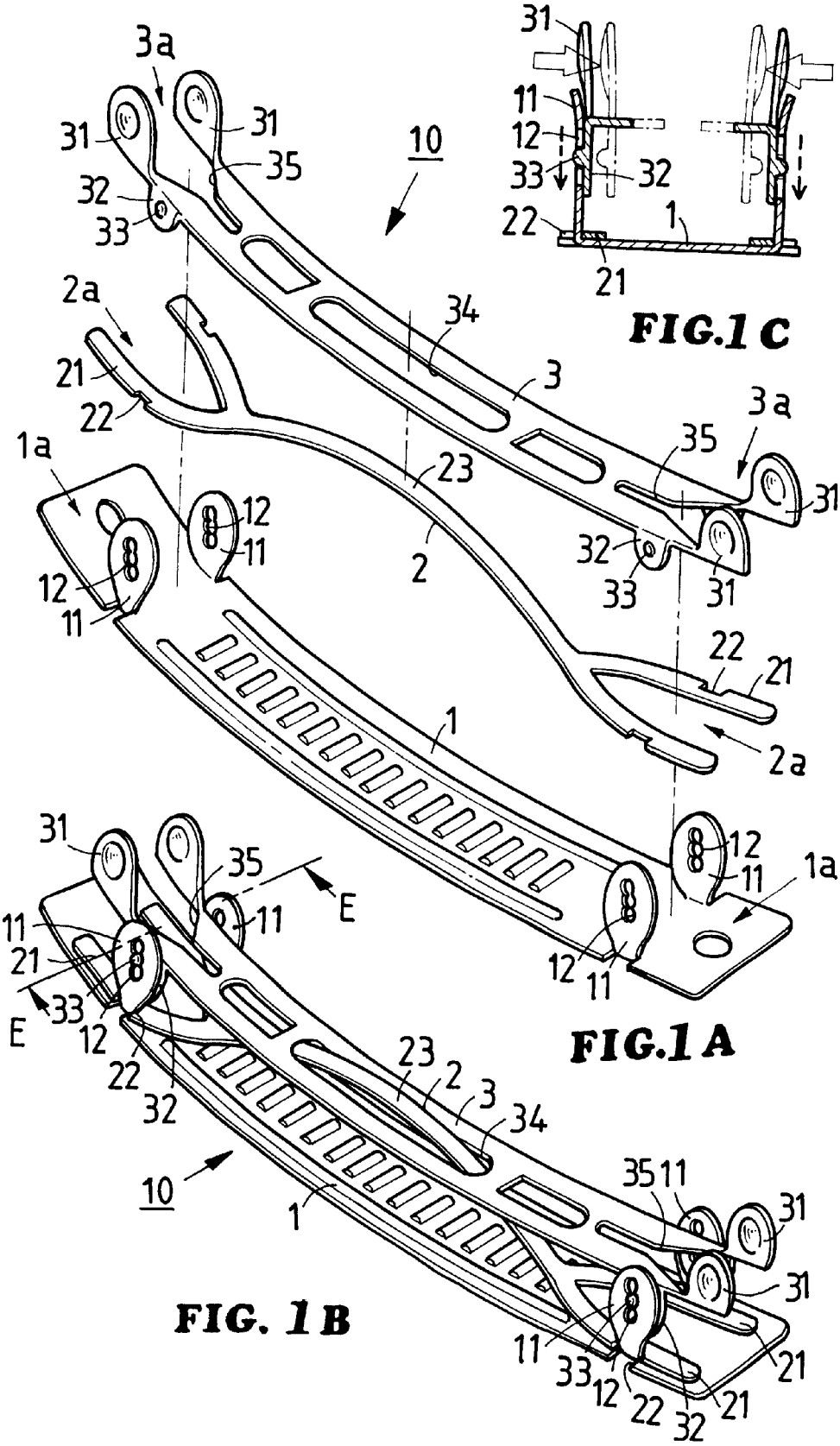
FIG. 1A is a perspective exploded view of a first embodiment of a first aspect of the hair clip of the present invention.
FIG. 1B is a perspective assembled view according to FIG. 1A.
FIG. 1C is a sectional view taken along line E—E of FIG. 1B.

Please refer to FIGS. 1A and 1B. According to a first embodiment of a first aspect of the present invention, the hair clip 10 includes a base plate 1, a leaf spring 2 and a clip plate 3.

Each end of the base plate 1 is disposed with a latch board end 1*a*. Each end of the leaf spring 2 is disposed with a latch fork end 2*a*. Each end of the clip plate 3 is disposed with a latch lug end 3*a*.

The latch board end 1(*a*) includes two latch boards 11 each of which is formed with a row of latch holes 12 communicated with each other. The latch lug end 3*a* includes two latch lugs 31 defining a fissure 35. A front lower side of each latch lug 31 is disposed with a downward extending lug 32 having a tenon 33 on its surface. When the base plate 1, leaf spring 2 and the clip plate 3 are assembled with each other, the V-shaped fork legs 21 of the latch fork end 2*a* of the leaf spring 2 are inserted under the latch boards 11 with the root sections of the latch boards 11 engaged in the engaging recesses 22 of the fork legs 21. The middle arch section 23 of the leaf spring is inserted into the central slot 34 of the clip plate 3. In addition, the tenons 33 of the clip plate 3 are inserted into the latch holes 12 of the latch boards 11 so as to achieve a clipping effect.

FIG. 1B shows the assembly of the hair clip, wherein the structure of each end of the hair clip is identical to the other so that the hair clip can be opened at both ends for a right-handed as well as a left-handed users. Also, the decorative article of the base plate 1 can be fixed in any direction. Moreover, the tenons 33 of the clip plate 3 can be selectively inserted into the latch holes 12 of the latch boards 11 at different heights so that the clip plate 3 can be adjusted upward or downward relative to the base plate 1 for tightly clipping the user's hair.

FIG. 1C shows the opening procedure of the hair clip, wherein the latch lugs 31 of the clip plate 3 are compressed by two fingers to shorten the distance between the latch lugs 31, whereby the tenons 33 are disengaged from the latch holes 12 of the latch boards 11. At this time, the resilience of the leaf spring 2 bounds the clip plate 3 away from the base plate 1 to open the hair clip. During the opening procedure, after one end of the hair clip is opened, the other end is then opened. During the assembling procedure of the hair clip 10, one end thereof is first latched and then the other end is latched. The tightness of the hair clip can be adjusted by means of depressing two ends of the clip plate 3, making the tenons 33 of the clip plate 3 downward move along the latch holes 12.

Figures 2A, 2B, 2C:
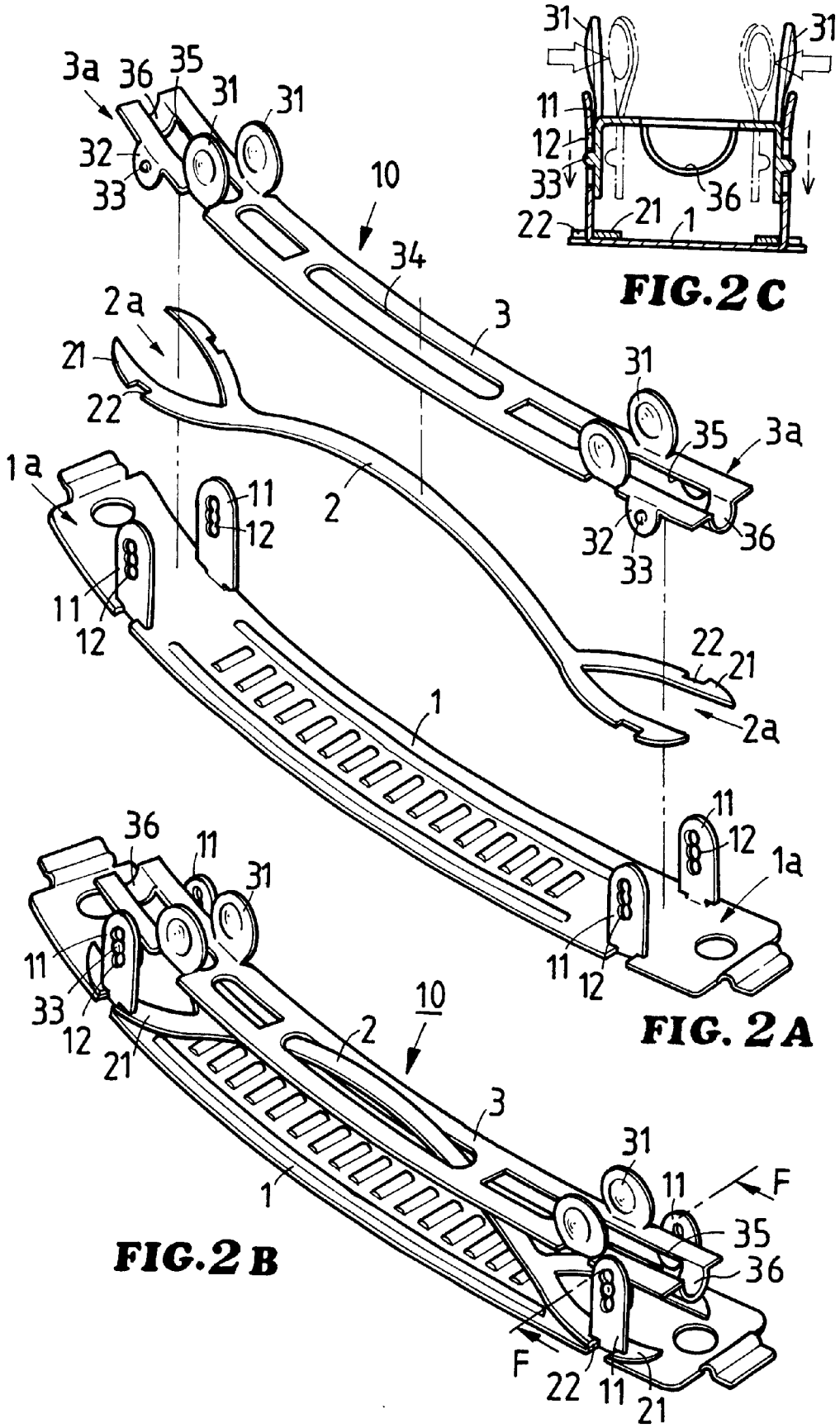
FIG. 2A is a perspective exploded view of a second embodiment of the first aspect of the hair clip of the present invention.
FIG. 2B is a perspective assembled view according to FIG. 2A.
FIG. 2C is a sectional view taken along line F—F of FIG. 2B.

Please refer to FIGS. 2A and 2B. According to a second embodiment of the first aspect of the present invention, the hair clip 10 includes a base plate 1, a leaf spring 2 and a clip plate 3.

This embodiment is different from that of FIGS. 1A and 1B only in the structure of the clip plate 3. The latch lugs 31 of the clip plate 3 are disposed at a position near the ends rather than at the ends. The downward extending lugs 32 are disposed behind the latch lugs 31. Each end of the clip plate 3 is formed with a fissure 35 and an arch bridging section 36 across the fissure 35. Although the shape and structure of the clip plate 3 are different from those of the clip plate 3 of FIGS. 1A and 1B, the engaging function of the clip plate 3 with the base plate 1 and the leaf spring 2 is identical to that of the clip plate 3 of FIGS. 1A and 1B.

When adjusting the tightness of the clip plate 3, the user only needs to compress two ends of the clip plate 3, making the tenons 33 thereof move downward along the latch holes 12. As shown in FIG. 2C, when the user compresses the latch lugs 31 of the clip plate 3 to shorten the distance therebetween via the fissure 35 and disengage the tenons 33 from the latch holes 12 of the latch boards 11, the leaf spring 2 will resiliently bound the clip plate 3 from the base plate 1 to open the hair clip.

Figures 3A, 3B, 3C:
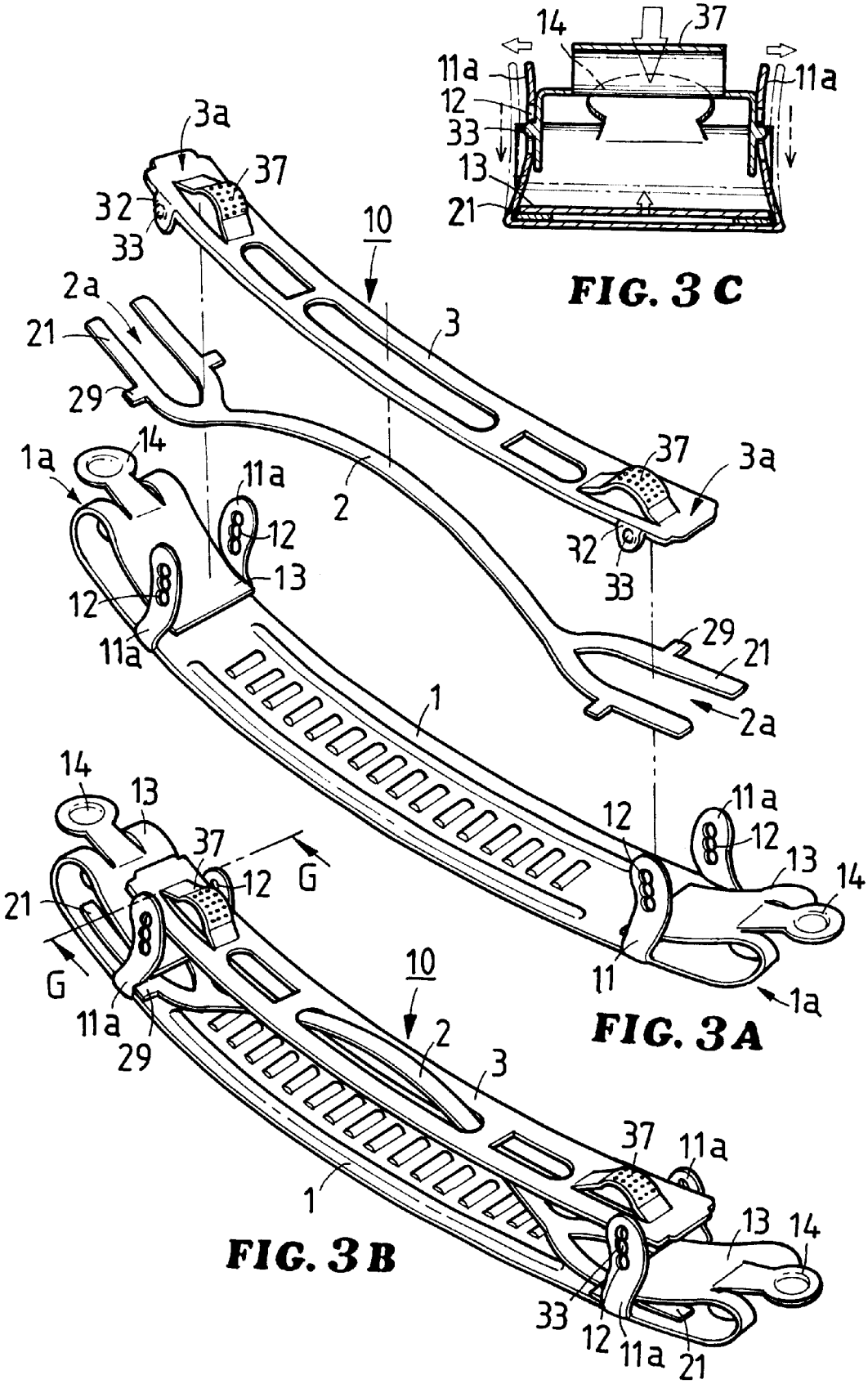
FIG. 3A is a perspective exploded view of a third embodiment of the first aspect of the hair clip of the present invention.
FIG. 3B is a perspective assembled view according to FIG. 3A.
FIG. 3C is a sectional view taken along line G—G of FIG. 3B.

Please refer to FIGS. 3A and 3B. According to a third embodiment of the first aspect of the present invention, the hair clip 10 includes a base plate 1, a leaf spring 2 and a clip plate 3.

This embodiment is different from that of FIGS. 1A and 1B only in the structure of two ends of the base plate 1 and the clip plate 3. Each end of the base plate 1 is formed with a bight folding plate 13. The center of the folding plate 13 is formed with a projecting depression key 14. In addition, the latch boards 11 are inward arched. A stopper block 29 is disposed on a lateral side of the fork leg 21 of the leaf spring 2. Each end of the clip plate 3 is disposed with a convex 37 instead of the latch lugs. Each side of the convex 37 is disposed with a lug 32 having a tenon 33 on its surface. Although the shape and structure of the base plate 1 and clip plate 3 are different from those of the base plate and clip plate of FIGS. 1A and 1B, the engaging function of the base plate 1 and clip plate 3 with the leaf spring 2 is identical to that of the base plate and clip plate of FIGS. 1A and 1B.

When adjusting the tightness of the clip plate 3, the user only needs to depress the convex 37 of the clip plate 3, making the tenons 33 thereof move downward along the latch holes 12. As shown in FIG. 3C, when the user depresses the depression key 14 of the latch board end 1*a*, the front end of the folding plate 13 is upward biased to outward stretch the arch latch boards 11, whereby the tenons 33 of the clip plate 3 are disengaged from the latch holes 12 of the latch boards 11. At this time, the leaf spring 2 will resiliently bound the clip plate 3 from the base plate 1 to open the hair clip.

Figures 4A, 4B, 4C:
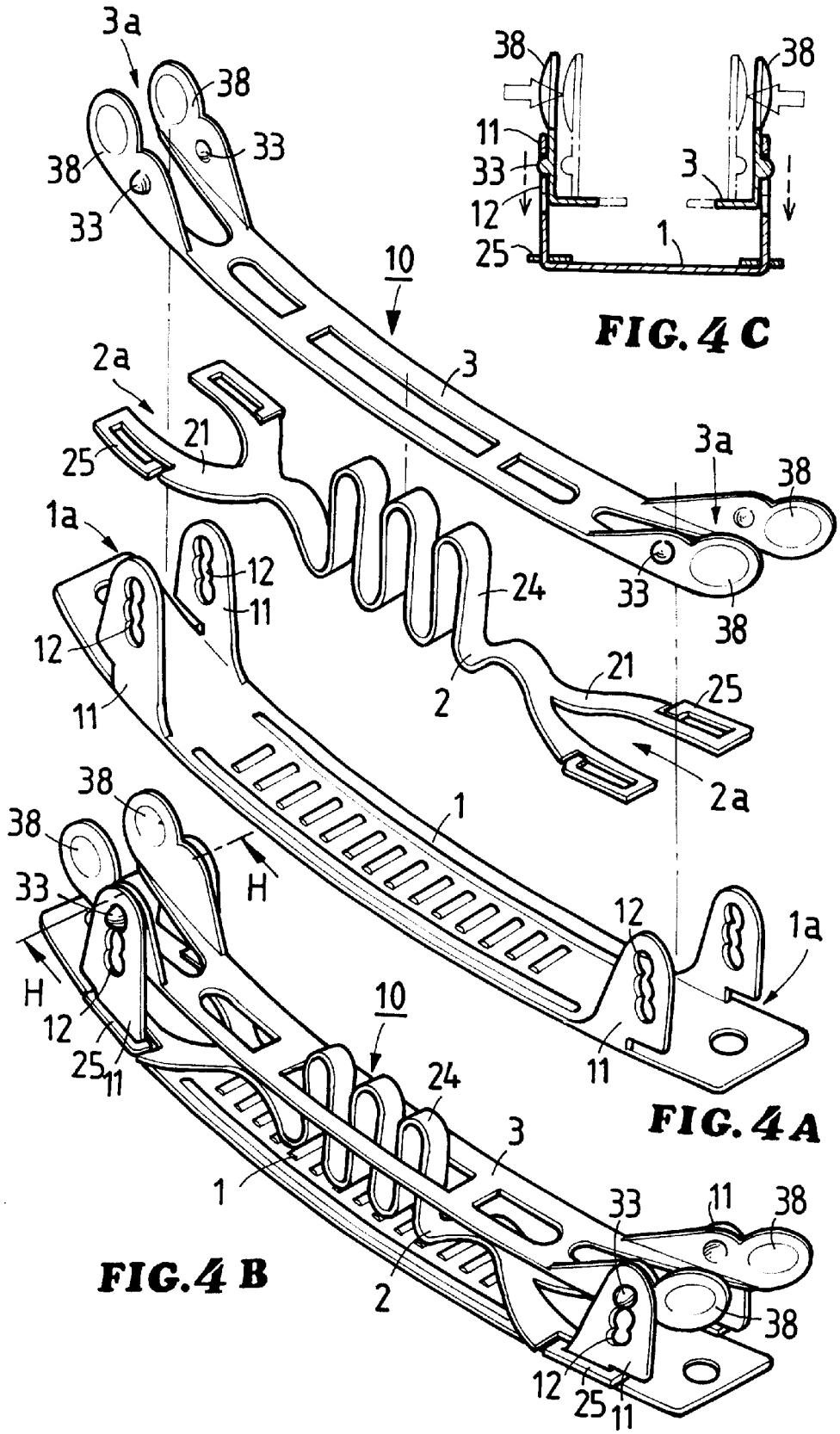
FIG. 4A is a perspective exploded view of a fourth embodiment of the first aspect of the hair clip of the present invention.
FIG. 4B is a perspective assembled view according to FIG. 4A.
FIG. 4C is a sectional view taken along line H—H of FIG. 4B.

Please refer to FIGS. 4A and 4B. According to a fourth embodiment of the first aspect of the present invention, the hair clip 10 includes a base plate 1, a leaf spring 2 and a clip plate 3.

This embodiment is different from that of FIGS. 1A and 1B only in the structure of two ends of the leaf spring 2 and the clip plate 3. The fork legs 21 of the leaf spring 2 are formed with reverse hook legs 25 and the central arch section of the leaf spring 2 is replaced by a well resilient winding section 24. The hook legs 25 are hooked at lower ends of the latch boards 11 of the base plate 1. The winding section 24 provides good resilience and enhances the clipping force for the hair. A pair of elongated oblique latch lugs 38 are disposed at each end of the clip plate 3. Each side of the latch lug 38 is disposed with a tenon 33 for adjustably inserting into the latch hole 12 of the latch board 11. Although the shape and structure of the leaf spring 2 and clip plate 3 are different from those of FIGS. 1A and 1B, the engaging function of the leaf spring 2 and the clip plate 3 with the base plate 1 is identical to that of the leaf spring and clip plate of FIGS. 1A and 1B.

When adjusting the tightness of the clip plate 3, the user only needs to compress two ends of the clip plate 3, making the tenons 33 thereof move downward along the latch holes 12. As shown in FIG. 4C, when the user compresses the latch lugs 38 of the clip plate 3 to shorten the distance therebetween, the tenons 33 will be disengaged from the latch holes 12 of the latch boards 11. At this time, the leaf spring 2 will resiliently bound the clip plate 3 from the base plate 1 to open the hair clip.

Figures 5A, 5B, 5C:
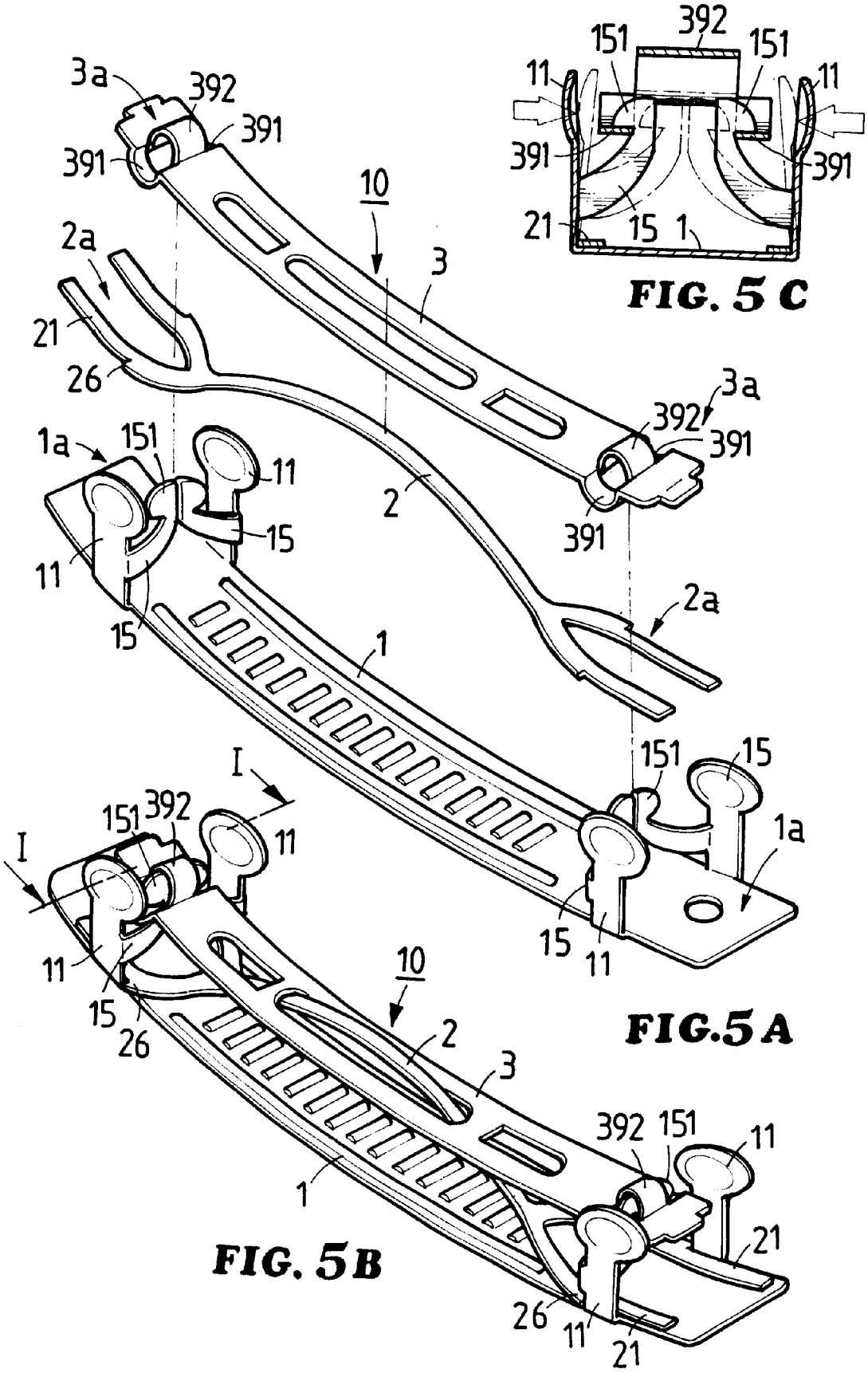
FIG. 5A is a perspective exploded view of a first embodiment of a second aspect of the hair clip of the present invention.
FIG. 5B is a perspective assembled view according to FIG. 5A.
FIG. 5C is a sectional view taken along line I—I of FIG. 5B.

Please refer to FIGS. 5A and 5B. According to a first embodiment of a second aspect of the present invention, the hair clip 10 includes a base plate 1, a leaf spring 2 and a clip plate 3.

This embodiment is different from that of FIGS. 1A and 1B only in the structure of two ends of the base plate 1 and the clip plate 3. A bent latch hook 15 inward extends from inner side of each latch board 11 of the base plate 1. The top end of each latch hook is formed with a reverse engaging hook 151. A pair of concaved engaging sockets 391 are disposed at two ends of the clip plate 3. An arch bridge 392 is disposed across the engaging socket. The fork legs 21 of the leaf spring 2 are formed with lances 26 for engaging with the latch boards 11 of the base plate 1. The engaging hooks 151 of the latch hooks 15 are hooked with the engaging sockets 391 of the clip plate 3 so as to assemble the base plate 1, leaf spring 2 and clip plate 3 together.

Such hair clip cannot be adjusted in tightness between the base plate 1 and the clip plate 3 according to the amount of the hair. However, such hair clip can be opened at both ends. When it is desired to separate the base plate 1 from the clip plate 3, as shown in FIG. 5C, the user only needs to compress the latch boards 11 of the base plate 1, making the latch boards 11 and the latch hooks 15 move inward so as to disengage the engaging hooks 151 from the engaging sockets 391 of the clip plate 3. The leaf spring 2 serves to resiliently bound the clip plate 3 from the base plate 1 to open the hair clip.

Figures 6A, 6B, 6C, 6D:
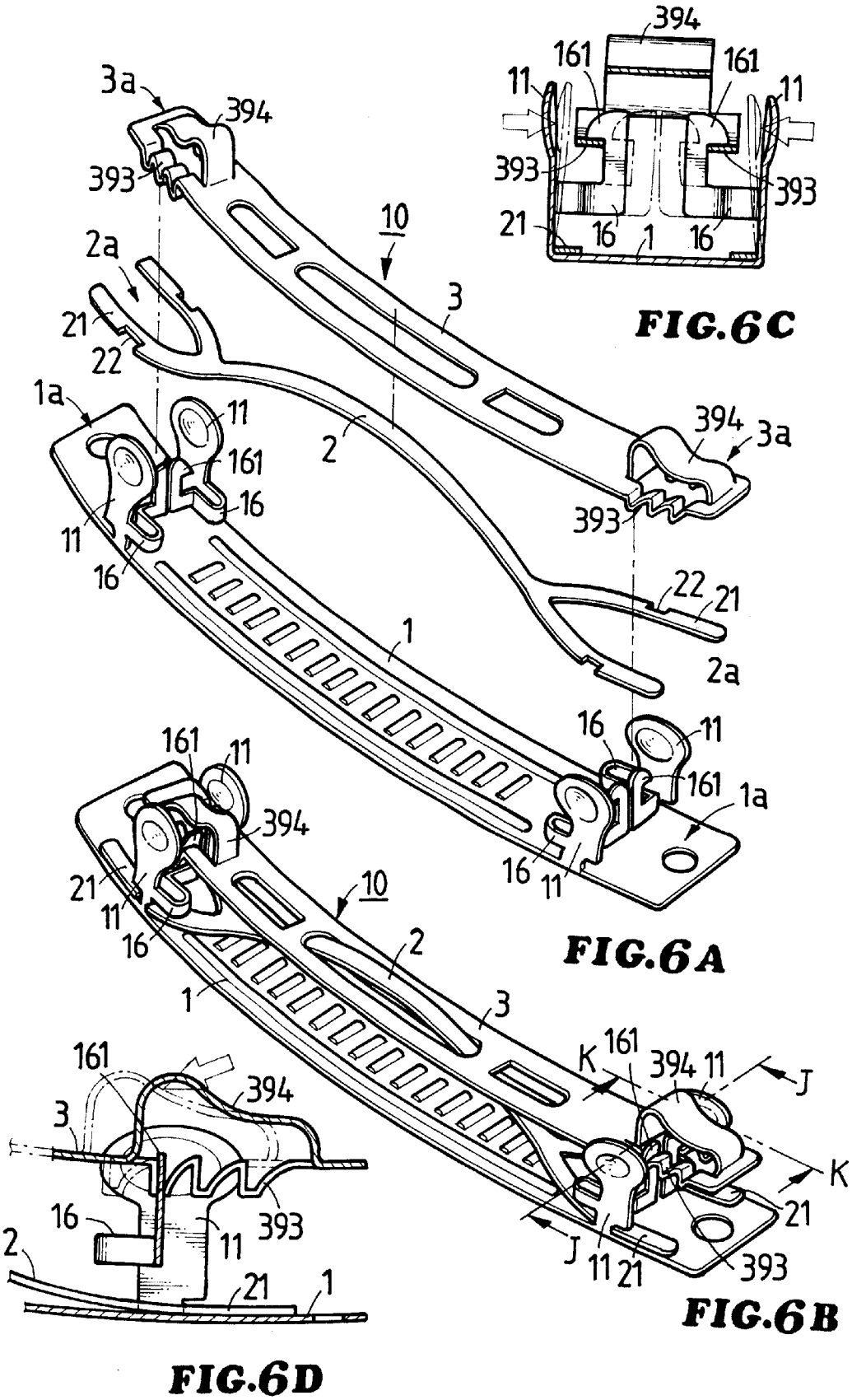
FIG. 6A is a perspective exploded view of a second embodiment of the second aspect of the hair clip of the present invention.
FIG. 6B is a perspective assembled view according to FIG. 6A.
FIG. 6C is a sectional view taken along line J—J of FIG. 6B.
FIG. 6D is a sectional view taken along line K—K of FIG. 6B.

Please refer to FIGS. 6A and 6B. According to a second embodiment of the second aspect of the present invention, the hair clip 10 includes a base plate 1, a leaf spring 2 and a clip plate 3.

This embodiment is different from that of FIGS. 5A and 5B only in the structure of two ends of the base plate 1 and the clip plate 3. Each end of the clip plate 3 is disposed with a downward projecting waved engaging socket 393 and an upward projecting mountain-shaped convex 394 over the engaging socket. The front end of the convex is higher than the rear end thereof for the user's finger to easily push and depress. The latch hook 16 of the base plate 1 horizontally extends from a lateral side of the latch board 11 to form a U-shaped section and an upright engaging hook 161 integrally connected therewith.

The engaging recesses 22 of the fork legs 21 of the leaf spring 2 are engaged with the latch boards 11 of the base plate 1 and the engaging hooks 161 of the base plate 1 are hooked with the waved engaging sockets 393 of the clip plate 3 so as to assemble the base plate 1, leaf spring 2 and clip plate 3 together.

Such hair clip 10 can be adjusted in tightness between the base plate 1 and the clip plate 3 and can be opened at both ends in such a manner that the user can push the convex 394 with one finger (as shown in FIG. 6D), making the engaging socket 393 move forward and making the engaging hook 161 hooked in one of the engaging sockets 393. When it is desired to separate the base plate 1 from the clip plate 3, as shown in FIG. 6C, the user only needs to compress the latch boards 11 of the base plate 1, making the latch boards 11 and the latch hooks 16 move inward so as to disengage the engaging hooks 161 from the engaging sockets 393 of the clip plate 3. The leaf spring 2 serves to resiliently bound the clip plate 3 from the base plate 1 to open the hair clip.

Figures 7A, 7B, 7C, 7D:
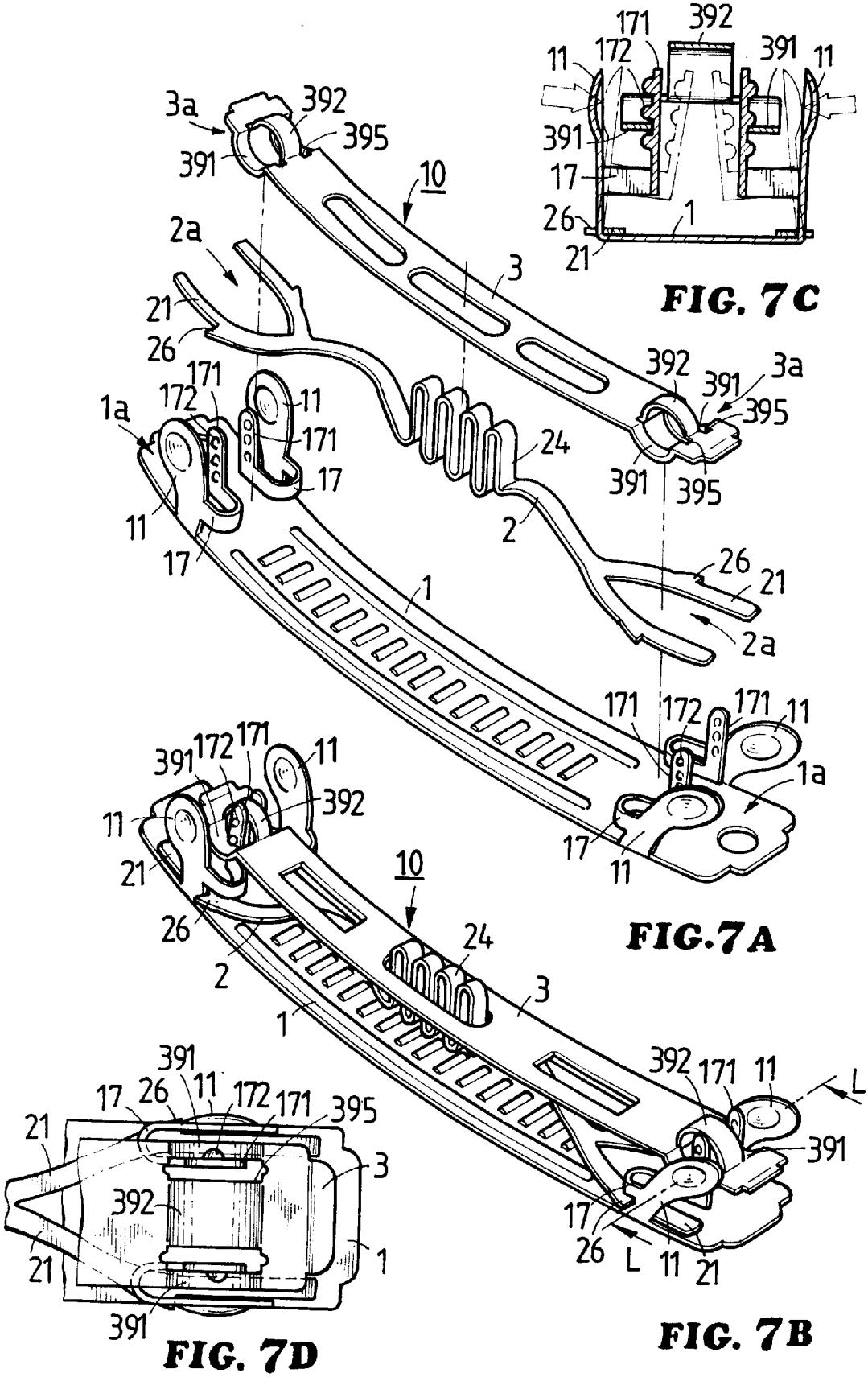
FIG. 7A is a perspective exploded view of a first embodiment of a third aspect of the hair clip of the present invention.
FIG. 7B is a perspective assembled view according to FIG. 7A.
FIG. 7C is a sectional view taken along line L—L of FIG. 7B.
FIG. 7D is a top view of right end of the hair clip of FIG. 7B.

Please refer to FIGS. 7A and 7B. According to a first embodiment of a third aspect of the present invention, the hair clip 10 includes a base plate 1, a leaf spring 2 and a clip plate 3.

This embodiment is different from that of FIGS. 5A and 5B only in the structure of two ends of the base plate 1. An inward bent latch arm 17 extends from inner side of each latch board 11. The latch arm 17 includes a horizontal U-shaped section and an upright section 171 formed with a vertical row of tenons 172. A fine slit 395 is defined between the engaging socket 391 and the convex 392 of the clip plate 3 (as shown in FIG. 7D). The upright section 171 of the base plate 1 is upward passed through the slit 395 and the lances 26 of the fork legs 21 of the leaf spring 2 are engaged with the latch boards 11 of the base plate 1, whereby the tenons 172 are engaged with the engaging sockets 391 of the clip plate 3 to assemble the base plate 1, leaf spring 2 and clip plate 3 together.

Such hair clip 10 can be adjusted in tightness between the base plate 1 and the clip plate 3 according to the amount of the hair and can be opened at both ends in such a manner that the user can depress the convex 392 of the clip plate 3 with one finger, making the engaging socket 391 move downward and reducing the height of the engaging socket 391 relative to the tenons 172. When it is desired to separate the base plate 1 from the clip plate 3, as shown in FIG. 7C, the user only needs to compress the latch boards 11 of the base plate 1, making the latch boards 11 and the latch arms 17 move inward so as to disengage the tenons 172 from the engaging sockets 391 of the clip plate 3. The leaf spring 2 serves to resiliently bound the clip plate 3 from the base plate 1 to open the hair clip.

Figure 8C:
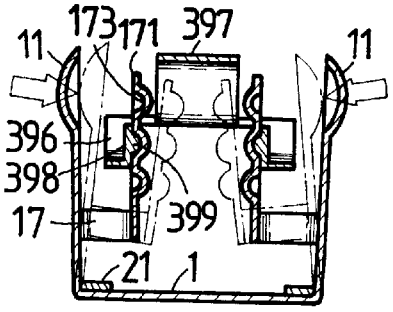
FIG. 8C is a sectional view taken along line M—M of FIG. 8B.
Figure 8A:
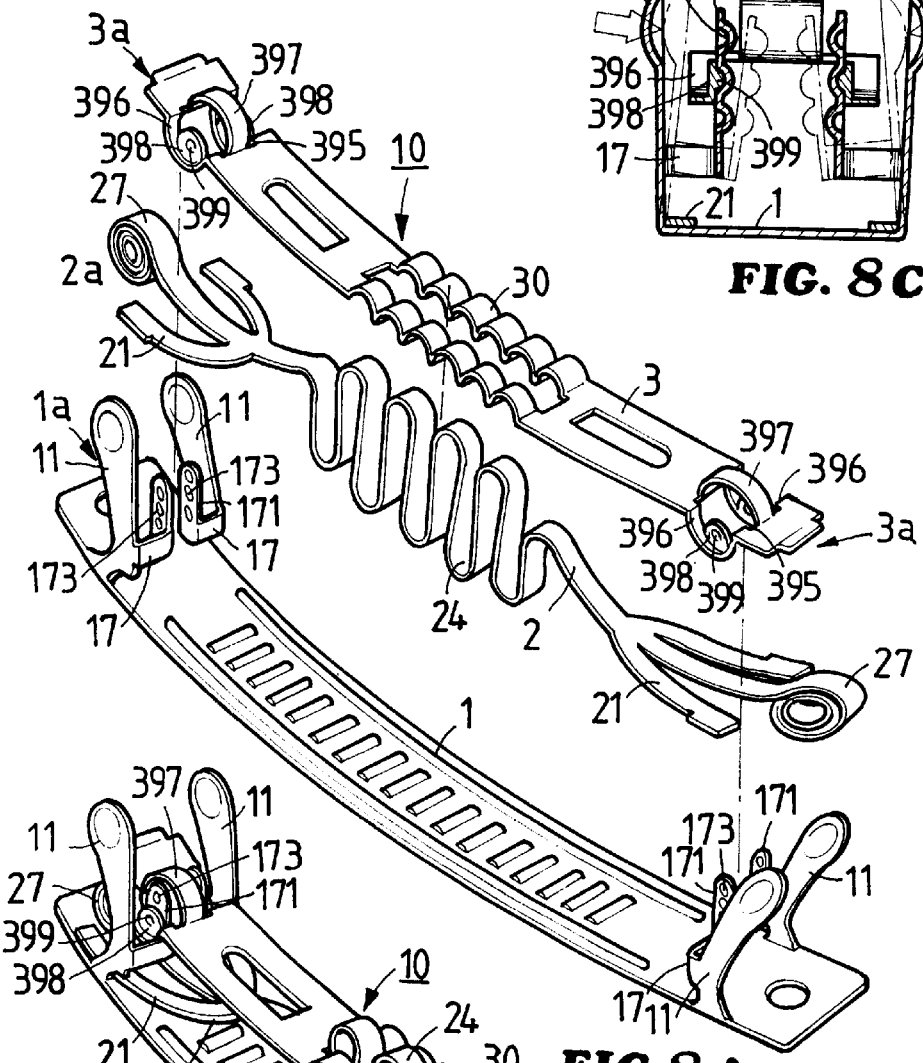
FIG. 8A is a perspective exploded view of a second embodiment of the third aspect of the hair clip of the present invention.
Figure 8B:
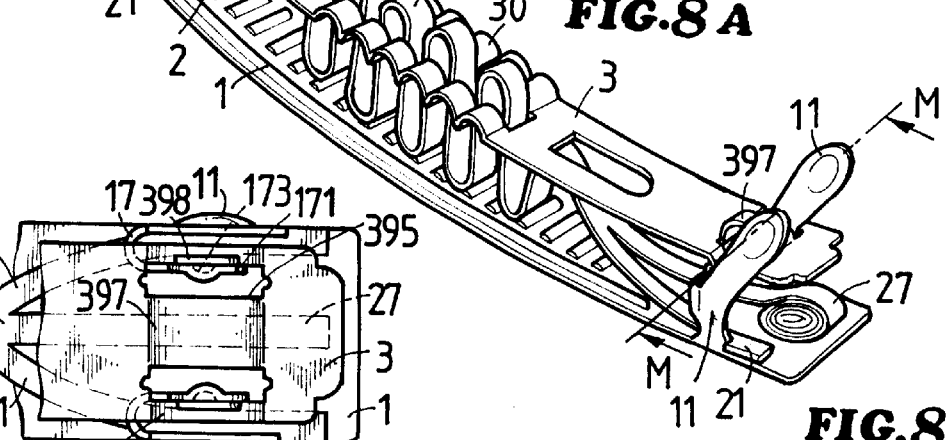
FIG. 8B is a perspective assembled view according to FIG. 8A.

Please refer to FIGS. 8A and 8B. According to a second embodiment of a third aspect of the present invention, the hair clip 10 includes a base plate 1, a leaf spring 2 and a clip plate 3.

Figure 8D:
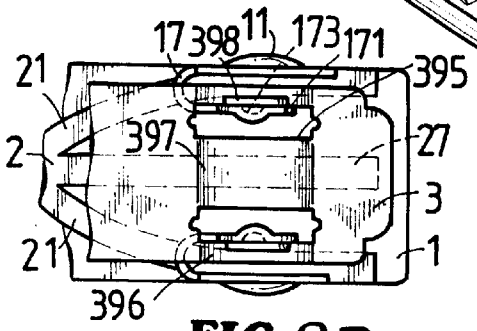
FIG. 8D is a top view of right end of the hair clip of FIG. 8B.

This embodiment is different from that of FIGS. 7A and 7B only in the structure of two ends of the leaf spring 2 and the structure of the clip plate 3. Each end of the leaf spring 2 is formed with two V-shaped fork legs 21 and a curled leg 27 outward extending from the center of the fork legs. The center of the leaf spring 2 is a winding section 24. Each end of the clip plate 3 is disposed with a pair of downward projecting arch rings 396 and an upward projecting arch bridge 397 between the arch rings. A slit 395 is defined between the arch ring and the arch bridge 397 (as shown in FIG. 8D). An upright lug 398 is disposed on inner side of the arch ring 396 and formed with an inward projecting tenon 399 on the surface. The center of the clip plate 3 is disposed with two parallel waved plates 30. The lances 28 of the fork lugs 21 of the leaf spring 2 serve to hook the latch boards of the base plate 1 and the upright sections 171 of the latch arms 17 of the base plate 1 pass through the slits 395 of the clip plate 3 with the tenons 399 engaged in the dents 173 of the upright sections 171 to assemble the base plate 1, leaf spring 2 and clip plate 3 together.

Such hair clip 10 can be adjusted in tightness between the base plate 1 and the clip plate 3 according to the amount of the hair and can be opened at both ends in such a manner that the user can depress two ends of the clip plate 3, making the tenons 399 move downward and reducing the height of the tenons 399 relative to the dents 173 of the base plate 1. When it is desired to separate the base plate 1 from the clip plate 3, as shown in FIG. 8C, the user only needs to compress the latch boards 11 of the base plate 1, making the latch boards 11 and the latch arms 17 move inward so as to disengage the tenons 399 from the dents 173. The leaf spring 2 serves to resiliently bound the clip plate 3 from the base plate 1 to open the hair clip.

Figures 9A, 9B, 9C, 9D:
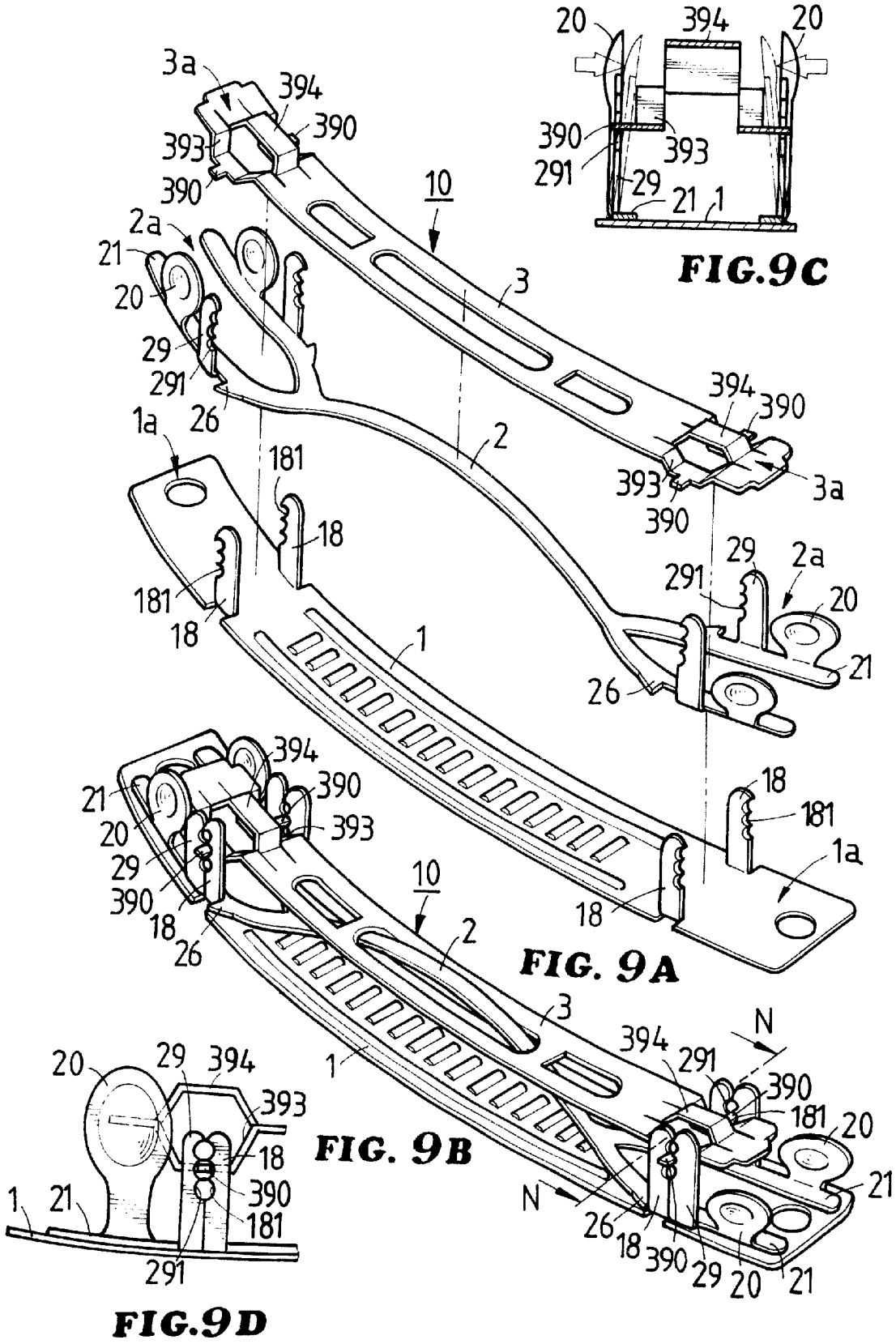
FIG. 9A is a perspective exploded view of a first embodiment of a fourth aspect of the hair clip of the present invention.
FIG. 9B is a perspective assembled view according to FIG. 9A.
FIG. 9C is a sectional view taken along line N—N of FIG. 9B.
FIG. 9D is a front view of right end of the hair clip of FIG. 9B.

Please refer to FIGS. 9A and 9B. According to a first embodiment of a fourth aspect of the present invention, the hair clip 10 includes a base plate 1, a leaf spring 2 and a clip plate 3.

This embodiment is different from the preceding one in the structure of two ends of the base plate 1, leaf spring 2 and clip plate 3. Each end of the base plate 1 is disposed with a pair of upright hook posts 18. A row of intercommunicated semicircular notches 181 are formed on one side of each hook post. In addition, each fork leg 21 of each end of the leaf spring 2 is disposed with a pair of upright latch boards 20 and a pair of hook posts 29 in front of the latch boards 20. A row of intercommunicated semicircular notches 291 are disposed on one side of each hook post 29. Each end of the clip plate 3 is disposed with a pair of downward projecting arch engaging sockets 393 and an arch bridge 394 between the engaging sockets 393. A projection 390 is disposed on outer side of each engaging socket 393.

The lances 26 of the fork legs 21 of the leaf spring 2 are hooked with the hook posts 18 of the base plate 1 and the hook posts 18 cooperate with the hook posts 29 of the leaf spring 2, whereby the semicircular notches 181, 291 thereof mate with each other to form a row of circular holes (as shown in FIG. 9D), The projection 390 of the clip plate 3 is inserted into the circular hole and the user can depress the projection 390 from the upper circular hole to the lower one so as to change the distance between the base plate 1 and the clip plate 3. When it is desired to separate the base plate 1 from the clip plate 3, the user only needs to compress the latch boards 20 of the leaf spring 2 and inward bias the latch boards 20 and the hook posts 29, whereby the semicircular notches 181, 291 no more mate with each other, permitting the projection 390 of the clip plate 3 to be disengaged from the circular hole. The leaf spring 2 serves to resiliently bound the clip plate 3 from the base plate 1 to open the hair clip.

Figures 10A, 10B, 10C:
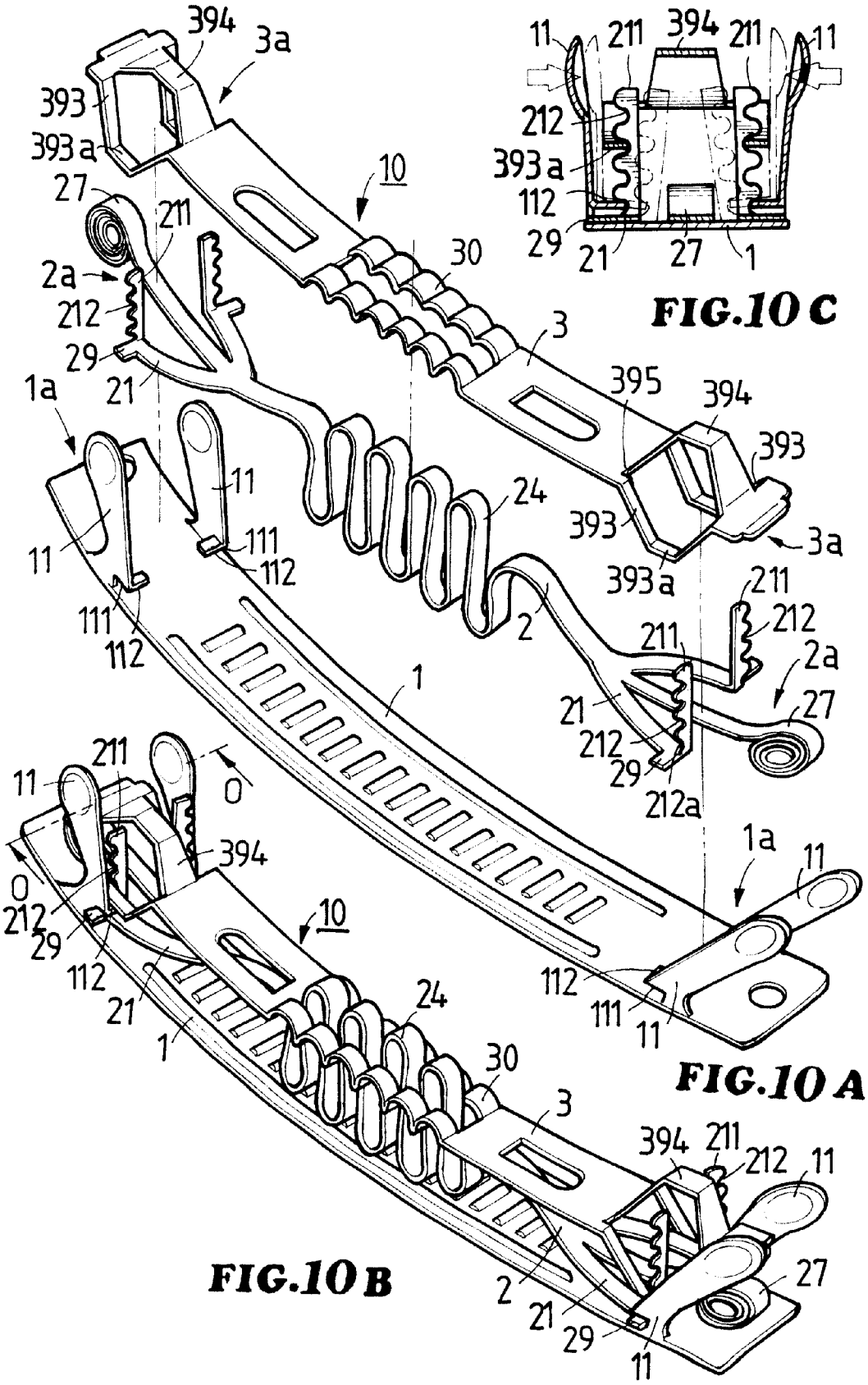
FIG. 10A is a perspective exploded view of a first embodiment of a fifth aspect of the hair clip of the present invention.
FIG. 10B is a perspective assembled view according to FIG. 10A.
FIG. 10C is a sectional view taken along line 0—0 of FIG. 10B.

Please refer to FIGS. 10A and 10B. According to a first embodiment of a fifth aspect of the present invention, the hair clip 10 includes a base plate 1, a leaf spring 2 and a clip plate 3.

This embodiment is different from the preceding one in the structure of two ends of the base plate 1, leaf spring 2 and clip plate 3. Each end of the base plate 1 is disposed with a pair of upright latch boards 11. A notch 111 is formed at front bottom section of each latch board 11 and a small pushing block 112 is integrally formed on inner side of the notch. The free end of each fork leg 21 of the leaf spring 2 is disposed with an upright latch post 211. A rack 212 is disposed on one side of the latch post 211. A curled leg 27 extends outward from the center of the fork legs 21. The center of the leaf spring 2 is disposed with a winding section 24. Each end of the clip plate 3 is disposed with a pair of arch engaging sockets 393. An arch bridge 394 is disposed between the engaging sockets 393. A slit 395 is defined between the arch bridge 394 and the engaging socket 393. The bottom of the engaging socket 393 is preferably a straight side 393*a*. The center of the clip plate 3 is disposed with two rows of waved plates 30.

The stopper blocks 29 on two sides of the fork legs 21 of the leaf spring 2 are inserted into the notches 111 of the latch boards of the base plate 1. The small pushing blocks 112 of the base plate 1 are engaged in the lowermost notch 212*a* of the rack of the latch post 211. The latch post 211 is upward passed through the slit 395 of the clip plate 3. The bottom of the engaging socket 393 is engaged with the rack 212 to achieve a locking effect. When it is desired to adjust the distance between the base plate 1 and the clip plate 3, the user only needs to depress the arch bridges 394 of the clip plate 3 and reduce the height of the base plate 1 relative to the clip plate 3. When it is desired to separate the base plate 1 from the clip plate 3, as shown in FIG. 10C, the user only needs to compress the latch boards 11 of the base plate 1 and inward push the latch posts 211 of the leaf spring 2 via the small pushing blocks 112 so as to disengage the racks 212 from the engaging sockets 393 of the clip plate 3. The leaf spring 2 serves to resiliently bound the clip plate 3 from the base plate 1 to open the hair clip.

Figure 11A:
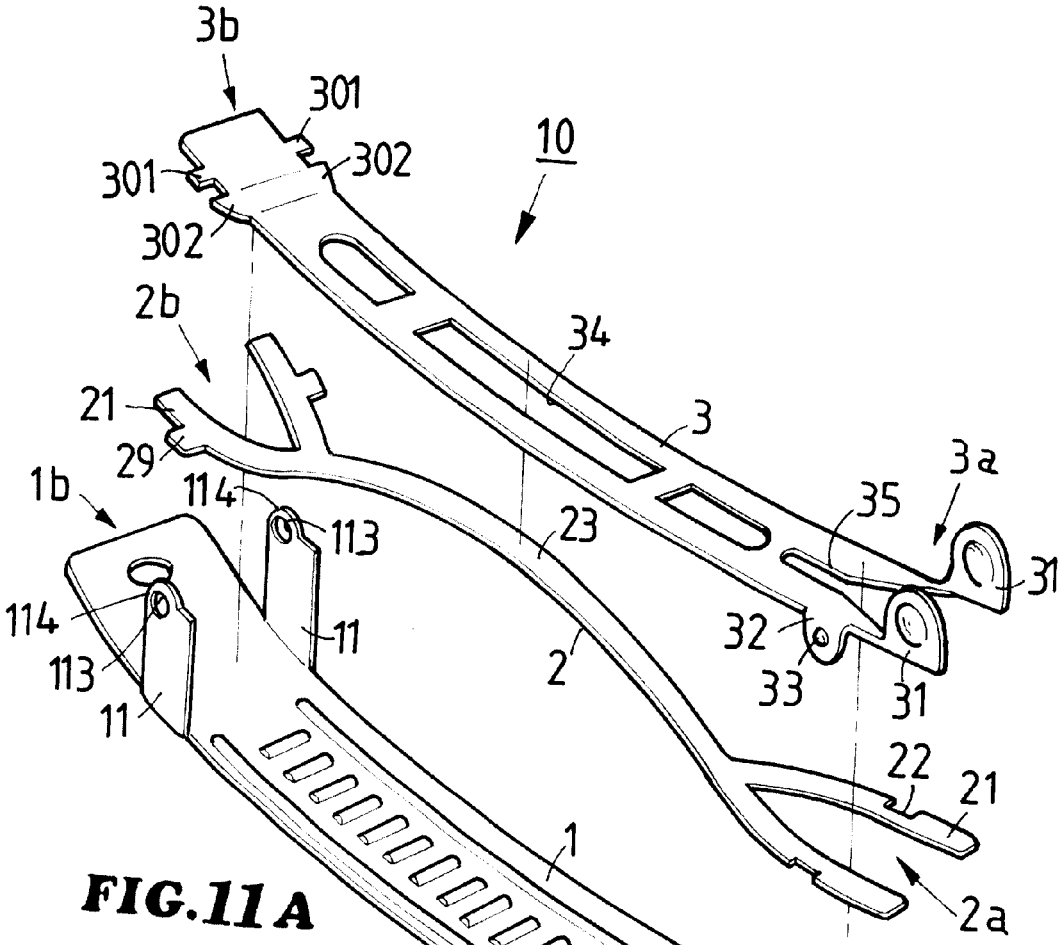
FIG. 11A is a perspective exploded view showing that the hair clip of the present invention is openable at one single end.
Figure 11B:
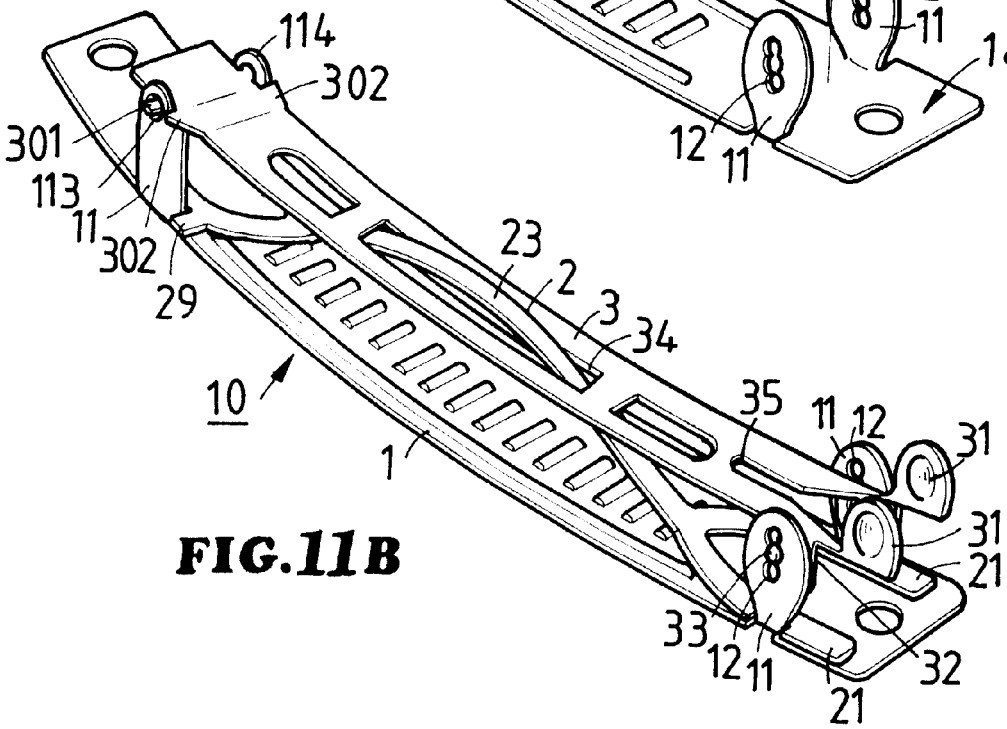
FIG. 11B is a perspective assembled view showing that the hair clip of the present invention is openable at one single end.

FIGS. 11A and 11B show an embodiment of the present invention, in which the hair clip is openable only at one end. The openable ends of the base plate 1, leaf spring 2 and clip plate 3 are identical to the above structures shown in FIGS. 1A and 1B and will not be repeatedly described. The other ends of the base plate 1, leaf spring 2 and clip plate 3 are conventional structures. The latch board 11 of latch board end 1(*b*) of the base plate 1 is formed with an orifice 113 on upper side. A tenon 301 is formed on one side of the latch lug end 3(*b*) of the clip plate 3. The tenon 301 is fitted into the orifice 113, whereby the clip plate 3 can be rotated about the tenon 301. A triangular stopper plate 302 of the clip plate 3 is stopped by the semicircular projection 114 on upper side of the latch board 11. The V-shaped fork legs 21 of the leaf spring 2 are stopped under the latch board 11 of the base plate 1 via the stopper block 29. The leaf spring 2 resiliently pushes and lifts the clip plate 3, whereby the clip plate 3 can be rotated through 180 degrees about the pivot end.

It is to be understood that the above description and drawings are only used for illustrating some embodiments of the present invention, not intended to limit the scope thereof. Any variation and derivation from the above description and drawings should be included in the scope of the present invention.

What is claimed is:

1. A stage-by-stage tightness-adjustable hair clip structure comprising a base plate, a leaf spring and a clip plate, each end of the base plate being disposed with a pair of latch boards, each end of the leaf spring being disposed with a pair of fork legs, each end of the clip plate being disposed with a pair of latch lugs, wherein:

the latch boards, fork legs and latch lugs are assembled to form an openable end or a pivot end, whereby the hair clip can be opened at both ends or at a single end.

2. A hair clip structure as claimed in claim 1, wherein each latch board is formed with a row of intercommunicated latch holes, the latch lugs defining a fissure therebetween, a downward extending lug being disposed on a front lower side of each latch lug, a tenon being formed on surface of the downward extending lug, the fork legs of the leaf spring being inserted under the latch boards of the base plate with root sections of the latch boards engaged in engaging recesses of the fork legs, a middle arch section of the leaf spring being inserted into a central slot of the clip plate, tenon of the clip plate being selectively inserted into the latch holes of the latch boards so as to assemble the clip plate and the leaf spring with the base plate.

3. A hair clip structure as claimed in claim 2, wherein each latch lug is disposed near the end of the clip plate and the downward extending lug is disposed between the latch lug and the end, an arch bridge being disposed at the end of and across the fissure of the clip plate.

4. A hair clip structure as claimed in claim 1, wherein each end of the base plate is formed with a bight folding plate, the center of the folding plate being formed with a projecting depression key, the latch boards being arched inward, a front end of the folding plate being inserted under and between the two latch boards, a stopper block being disposed on a lateral side of each fork leg of the leaf spring, each end of the clip plate being disposed with a convex, each side of the convex being disposed with a lug having a tenon on its surface.

5. A hair clip structure as claimed in claim 1, wherein the fork legs of the leaf spring are formed with reverse hook legs and the center of the leaf spring is disposed with a well resilient winding section, the hook legs being hooked at lower ends of the latch boards of the base plate, a pair of elongated oblique latch lugs being disposed at each end of the clip plate to define a fissure, each side of the latch lug being disposed with a tenon for adjustably inserting into the latch holes of the latch board.

6. A hair clip structure as claimed in claim 1, wherein a bent latch hook extends inward from inner side of each latch board of the base plate, a top end of each latch hook being formed with a reverse engaging hook, a pair of concaved engaging sockets being disposed at two ends of the clip plate, an arch bridge being disposed across each engaging socket, the fork legs of the leaf spring being formed with lances for engaging with the latch boards of the base plate.

7. A hair clip structure as claimed in claim 6, wherein each end of the clip plate is disposed with a pair of downward projecting waved engaging sockets and an upward projecting convex over the engaging sockets, a front end of the convex being higher than a rear end thereof, the latch hook of the base plate extending horizontally from a lateral side of the latch board to form a U-shaped section and an upright engaging hook integrally connected therewith, each fork leg of the leaf spring being disposed with an engaging recess.

8. A hair clip structure as claimed in claim 1, wherein an inward bent latch arm extends from inner side of each latch board, the latch arm including a horizontal U-shaped section and an upright section formed with a vertical row of tenons, the clip plate being disposed with a convex and two arch engaging sockets on two sides of the convex, a slit being defined between the engaging socket and the convex of the clip plate, the upright section of the base plate being passed upward through the slit, the fork legs of the leaf spring being disposed with lances.

9. A hair clip structure as claimed in claim 1, wherein each pair of fork legs is formed with two V-shaped fork legs and a curled leg extending outward from the center of the fork legs, the center of the leaf spring being a winding section, each end of the clip plate being disposed with a pair of downward projecting arch rings and an upward projecting arch bridge between the arch rings, a slit being defined between the arch ring and the arch bridge, a latch arm horizontally extending from an inner side of the latch board, including an upright section formed with a row of dents, the upright section being passed through the slit of the clip plate with the tenon of the lug engaged in the dents of the upright sections.

10. A hair clip structure as claimed in claim 1, wherein each end of the base plate is disposed with a pair of upright hook posts, a row of intercommunicated semicircular notches being formed on one side of each hook post, each fork leg of each end of the leaf spring being disposed with a pair of upright latch boards and a pair of hook posts in front of the latch boards, a row of intercommunicated semicircular notches being disposed on one side of each hook post, each end of the clip plate being disposed with a pair of downward projecting arch engaging sockets and an arch bridge between the engaging sockets, a projection being disposed on outer side of each engaging socket, the hook posts of the fork legs cooperating with the hook posts of the leaf spring, whereby the semicircular notches thereof mate with each other to form a row of circular holes, the projection of the clip plate being selectively inserted into the circular holes.

11. A hair clip structure as claimed in claim 1, wherein a notch is formed at front bottom section of each latch board and a small pushing block being integrally formed on inner side of the notch, a free end of each fork leg of the leaf spring being disposed with an upright latch post, a rack being disposed on one side of the latch post, a curled leg extending outward from the center of the fork legs, the center of the leaf spring being disposed with a winding section, each end of the clip plate being disposed with a pair of arch engaging sockets, an arch bridge being disposed between the engaging sockets, a slit being defined between the arch bridge and the engaging socket, the bottom of the engaging socket being a straight side, the center of the clip plate being disposed with two rows of waved plates, the small pushing blocks of the base plate being engaged in the lowermost notch of the rack of the latch post, the latch post being passed upward through the slit of the clip plate, the bottom of the engaging socket being engaged with the rack.

* * * * *